US009463477B2

(12) United States Patent
Lin et al.

(10) Patent No.: US 9,463,477 B2
(45) Date of Patent: Oct. 11, 2016

(54) DEMOUNTABLE SHOWERHEAD WITH TEARING MODE

(71) Applicant: XIAMEN SOLEX HIGH-TECH INDUSTRIES CO., LTD., Xiamen, Fujian (CN)

(72) Inventors: Fengde Lin, Xiamen (CN); Xiaowei Du, Xiamen (CN); Yuanfang Huang, Xiamen (CN); Huasong Zhou, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 124 days.

(21) Appl. No.: 14/055,243

(22) Filed: Oct. 16, 2013

(65) Prior Publication Data

US 2014/0110507 A1 Apr. 24, 2014

(30) Foreign Application Priority Data

Oct. 19, 2012 (CN) ..... 2012 1 0401996

(51) Int. Cl.
*A62C 2/08* (2006.01)
*B05B 1/18* (2006.01)

(52) U.S. Cl.
CPC ..... *B05B 1/185* (2013.01)

(58) Field of Classification Search
CPC ..... B05B 1/185
USPC ..... 239/548
See application file for complete search history.

(56) References Cited

U.S. PATENT DOCUMENTS

| | | | | |
|---|---|---|---|---|
| 6,270,022 | B1 * | 8/2001 | Knapp | 239/428.5 |
| 6,382,531 | B1 * | 5/2002 | Tracy | 239/548 |
| 2002/0109023 | A1 * | 8/2002 | Thomas et al. | 239/562 |
| 2006/0043214 | A1 * | 3/2006 | Macan et al. | 239/222.11 |
| 2006/0060678 | A1 * | 3/2006 | Mazzola | 239/552 |
| 2011/0233301 | A1 * | 9/2011 | Gopalan et al. | 239/101 |
| 2012/0181356 | A1 * | 7/2012 | Miller et al. | 239/548 |

* cited by examiner

*Primary Examiner* — Arthur O Hall
*Assistant Examiner* — Adam J Rogers
(74) *Attorney, Agent, or Firm* — Rabin & Berdo, P.C.

(57) ABSTRACT

A demountable showerhead with tearing mode has backstop mouths arranged on an outlet surface of a shower. Each backstop mouth is disposed with an outlet waterway to connect to the waterway of the shower. The outlet waterway has a big and small end, and is contracted along the outlet direction of the shower, and a flexible cover, which comprise bowl shape plugs and a flexible connector connected to the bowl shape plugs; each plug has a big and small end, the small end of the plug is connected to the connector, the big end of the bowl shape plug is deformed and plugged into the small end of the backstop mouth, the external wall of the plug is coupled to the outlet waterway in elastic way; the internal wall of the plug is contracted along the outlet direction, the bottom of the external wall is disposed with outlet holes.

9 Claims, 2 Drawing Sheets

DEMOUNTABLE SHOWERHEAD WITH TEARING MODE

FIELD OF THE INVENTION

The present invention relates to sanitary ware, especially to demountable showerhead with tearing mode.

BACKGROUND OF THE INVENTION

The outlet component of the shower usually has many holes, under the work of the water pressure, the water is separated to several outlets to clean and shower. Basic on that, the shower outlet component is exposed in the air and contacted with the dust and other dirt, so that in one hand, the outlet component is easy to block, in another hand, it is easy to deposit the dirt in the air under the humid environment, making the outlet waterway deformed and the spray effect of the shower weakened or even fail. That is an important reason of the failure of a shower, the service life is shortened. Existing solving method is to design the outlet component to be a detachable one, so that the outlet component can be taken down to clean or replaced. To ensure the usage life of the shower, the outlet component is usually a cover, which is an outlet surface with several throughout holes, the entirety is detachable with respect to the front side of the shower. This kind of structure can be produced and assembled in existing technology, so it is popularly used. But it has disadvantages that it requires sharp instrument to lift and detach the entire component, so from the user's view angle, the detachable component is inconvenient. Moreover, the shower is easy to damage with sharp instrument, which affects the appearance.

SUMMARY OF THE INVENTION

The present invention is provided with demountable showerhead with tearing mode to solve the problems of the existing shower that the disassembly component of the cover is inconvenient to disassemble and is easy to damage, the technical proposal is as below:

Demountable showerhead with tearing mode comprising:

backstop mouths, which are arranged on the outlet surface of the shower, the internal of each backstop mouth is disposed with an outlet waterway to connect to the waterway of the shower, the outlet waterway is disposed with a big end and a small end, and is contracted along the outlet direction of the shower, and a flexible cover, which comprising bowl shape plugs and a flexible connector connected to the bowl shape plugs; each bowl shape plug is disposed with a big end and a small end, the small end of the bowl shape plug is connected to the connector, the big end of the bowl shape plug is deformed and plugged into the small end of the backstop mouth, the external wall of the bowl shape plug is coupled to the outlet waterway in elastic way; the internal wall of the bowl shape plug is contracted along the outlet direction of the shower, the bottom of the external wall is disposed with outlet holes; when water flows through the outlet waterway of the shower, the internal wall of the bowl shape plug is pressed, so that the external wall of the bowl shape plug is coupled to fix to the outlet waterway.

In another preferred embodiment, the small end of the bowl shape plug is connected to the connector by a positioning base; the external wall of the positioning base is gradually enlarged from the bottom of the bowl shape plug along the outlet direction of the shower; the end of the outlet waterway is disposed with an expanding mouth coupled to the external wall of the positioning base.

In another preferred embodiment, the external surface of the connector is coplanar with the external surface of the bottom of the bowl shape plug, the internal surface of the connector is coupled to the external wall of the outlet surface.

In another preferred embodiment, the external edge of the connector is laterally disposed with a protruding portion, the protruding portion is fixed with a flexible spot; the spot is inserted into a hole of the outlet surface.

In another preferred embodiment, the internal wall and the external wall of the bowl shape plug and the outlet waterways are smooth taperhole shaped.

In another preferred embodiment, the bowl shape plugs and the connector are one step forming, and are made of silicon.

In another preferred embodiment, the bowl shape plugs are symmetrically arranged about the central axis of the outlet surface of the shower.

In another preferred embodiment, the interference of the external wall of the bowl shape plug and the outlet waterway is larger than 0.4 mm In another preferred embodiment, the guiding length of the external wall of the bowl shape plug coupled to the outlet waterway along the outlet direction of the shower is larger than 2.2 mm.

The advantages of the technical proposal of the present invention are as below:

1. When to clean the flexible cover, handhold the connector to pull it out of the outlet surface, then it can quickly take it down to clean; when to assemble, plug the bowl shape plugs to the backstop mouths one by one, and press the whole surface of the connector to fix the flexible cover. The assembly and disassembly of the cover of the present invention requires no levering instruments or rotating instrument, it is labor saving and time saving, and is convenient and fast, moreover it won't damage the shower body.

2. each bowl shape plug is in the outlet waterway of the shower, when water inside of the shower flows through the outlet waterways in a proper water pressure, the internal wall of the bowl shape plug is pressed, so that the external wall of the bowl shape plug is coupled to fix to the outlet waterway, it is easy to assemble and disassemble with well water pressure ability.

3. the positioning base and the bowl shape plug have elastic stress in the two ends in the axis direction, so that the positioning of the bowl shape plug is accurate with well sealing performance; moreover the weak bottom of the bowl shape plugs is strengthened, increasing the service life under bending and pressing.

BRIEF DESCRIPTION OF THE DRAWINGS

The present invention will be further described with the drawings and the embodiments.

DETAILED DESCRIPTION OF THE EMBODIMENTS

Figure 4:
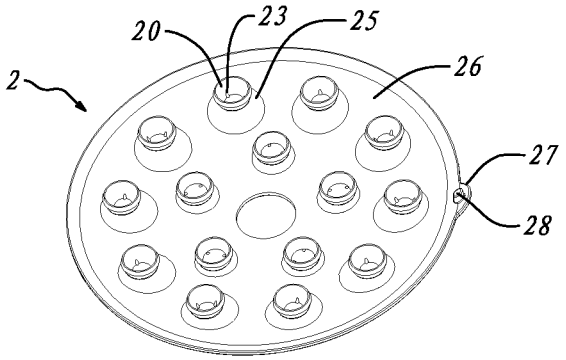
FIG. 4 illustrates the structure of the flexible cover 2 of FIG. 1.

A preferred embodiment of the present invention is figured in fig. to FIG. 4.

Figure 1:
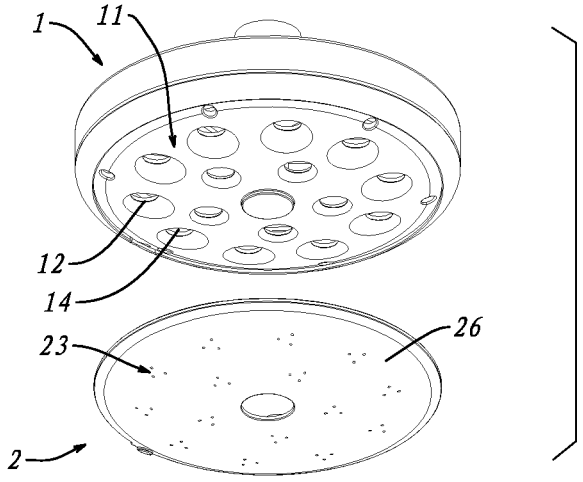
FIG. 1 illustrates the structure of an embodiment of the present invention.
Figure 2:
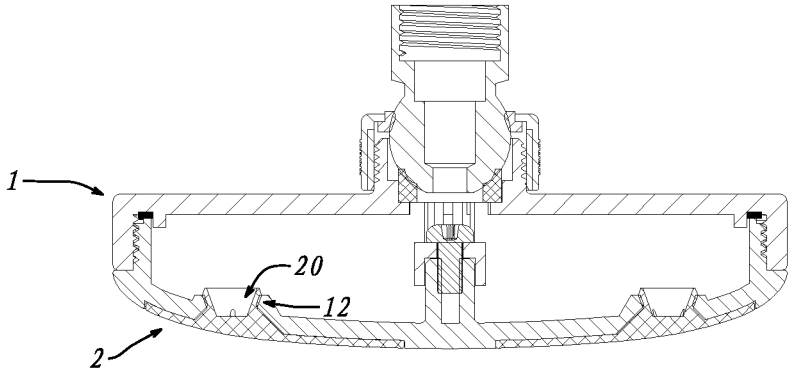
FIG. 2 illustrates the sectional view of the embodiment of FIG. 1.
Figure 3:
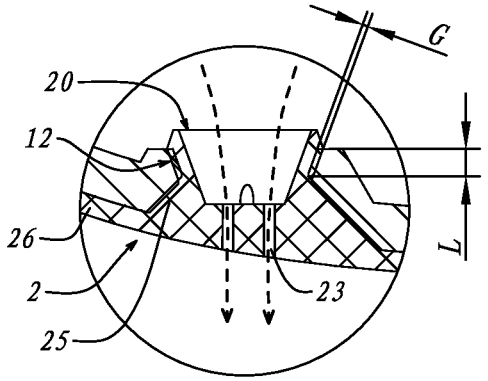
FIG. 3 illustrates the enlargement view of the A part of FIG. 2.

As figured in FIG. 1, in this embodiment, a demountable showerhead with tearing mode is provided, it comprising two detachable parts, which are the shower body 1 and the flexible cover 2; the flexible cover 2 is fixed to the external of the outlet surface 11 of the shower body 1. on the outlet surface 11 of the shower body 1, there are several backstop mouths 12 arranged. With FIG. 3, the internal of each backstop mouth 12 has a outlet waterway 14 connected to the waterway of the shower, the outlet waterway 14 has a big end and a small end, and is contracted along the outlet direction of the shower (as the dotted arrow figured).

The flexible cover 2 is a independent body, it comprising flexible bowl shape plugs 20 and a flexible connector 26 connected to the bowl shape plugs 20; that is to say, the connector 26 is serviced to connect these several bowl shape plugs 20 to an integrity; thereinto, the bowl shape plug 20 has a big end and a small end as well, the big end and the small end of the bowl shape plugs 20 are corresponding to that of the outlet waterways 14, the small end of the bowl shape plug 20 is connected to the connector 26 in the small end of the outlet waterway 14, the big end of the bowl shape plug 20 is in the big end of the outlet waterway 14. during actual assembly, after the bowl shape plugs 20 are deformed to plug into the small end of the backstop mouths 12, the bowl shape plugs 20 are recovered in form, so that the external wall of the bowl shape plugs is coupled to the outlet waterways 14; the internal wall of the bowl shape plugs 20 is contracted along the outlet direction of the shower, the bottom of the bowl shape plugs 20 has outlet holes 23.

It can be seen that, each bowl shape plug 20 on the flexible cover 2 has a corresponding backstop mouth 12 to fix, all of the bowl shape plugs 20 are connected to the same connector 26, so that when to clean the flexible cover 2, just handhold the connector 26, pull it out of the outlet surface 11 to take it down quickly to clean; when to assemble, just plug the bowl shape plugs 20 into the backstop mouths 12 one by one, finally press the whole connector surface to implement the fixation of the flexible cover 2. The assembly and disassembly of the cover of the present invention requires no levering instruments or rotating instrument, it is labor saving and time saving, and is convenient and fast. Moreover, each bowl shape plug 20 is in the outlet waterway of the shower, when water inside of the shower flows through the outlet waterways 14 in a proper water pressure, the internal wall of the bowl shape plug 20 is pressed, so that the external wall of the bowl shape plug is coupled to fix to the outlet waterway 14, it is easy to assemble and disassemble with well water pressure ability. As figured in FIG. 3, in this embodiment, the interference G of the external wall of the bowl shape plug 20 and the outlet waterway 14 is 0.4 mm, and the guiding length L of the external wall of the bowl shape plug 20 coupled to the outlet waterway 14 along the outlet direction of the shower is 2.2 mm so that it has small size and enough strength.

Besides above basic advantages, there are several performances in this embodiment:

The small end of the bowl shape plug 20 is connected to the connector 26 by a positioning base 25; the external wall of the positioning base 25 is gradually expanded from the bottom of the bowl shape plug 20 along the outlet direction of the shower (as the dotted arrow figured in FIG. 3); meanwhile the internal wall of the outlet waterways 14 has an expanding mouth coupled to the external wall of the positioning base 25, so that in one hand, the positioning base 25 and the bowl shape plug 20 have elastic stress in the two ends in the axial direction, making the positioning 20 more accurate with well sealing performance; in the other hand, with the positioning base 25, the weak bottom of the bowl shape plugs 20 is strengthened, increasing the service life under bending and pressing. The connector 26 of this embodiment is a smooth thin piece, the external surface is coplanar with the external surface of the bottom of the bowl shape plug 20, while the internal surface is coupled to the external wall of the outlet surface 11 of the shower body, making it has a well sealing performance and well strength without more material.

The edge of the connector 26 is laterally disposed with a protruding portion 27, which is fixed with a flexible protruding spot 28, the protruding spot 28 is inserted into a spot hole of the outlet surface 11 (not figured out), the protruding portion 27 is used to make it easy to pull the connector 26 out, and the spot 28 is used to fix the protruding portion 27, during actual operation, the protruding portion 27 is coupled to the outlet surface 11 as same as the connector 26 until pulling the spot 28 out, so that the connector 26 is not easy to take down by other foreign matters.

Besides, the internal wall and the external wall of the bowl shape plugs and the outlet waterways 14 of this embodiment are smooth taperhole shaped. They are well coupled and easy to shape; the bowl shape plugs 20 and the connector 26 are one step forming, and are made of silicon. The shape is stable and the forming technology is mature. Moreover, the bowl shape plugs 20 are symmetrically arranged about the central axis of the outlet surface of the shower, so that the whole flexible cover 2 is uniformly stressed with respect to the shower body 1.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. Demountable showerhead with tearing mode, wherein comprising:

backstop mouths, which are arranged on an outlet surface of the shower, an inside of each backstop mouth is disposed with an outlet waterway to connect to the waterway of the shower, the outlet waterway is disposed with a big end and a small end, the big end wider than the small end, and is contracted along the outlet direction of the shower, and a flexible cover, which comprising bowl shape plugs and a flexible connector connected to the bowl shape plugs;

each bowl shape plug is disposed with a first end and a second end, wherein the first end of the bowl shape plug is of larger diameter than the second end of the bowl shape plug, the second end of the bowl shape plug is connected to the connector, the first end the bowl shape plug is deformed and inserted into the small end of the outlet waterway of the backstop mouth, and the external wall of the bowl shape plug is elastically coupled to the outlet waterway;

the internal wall of the bowl shape plug is contracted along the outlet direction of the shower, the bottom of the external wall is disposed with outlet holes; when water flows through the outlet waterway of the shower, the internal wall of the bowl shape plug is pressed, so that the external wall of the bowl shape plug is coupled to fix to the outlet waterway.

2. Demountable showerhead with tearing mode according to claim 1, wherein the second end of the bowl shape plug is connected to the connector by a positioning base;

the external wall of the positioning base is gradually enlarged from the bottom of the bowl shape plug along the outlet direction of the shower;

the end of the outlet waterway is disposed with an expanding mouth coupled to the external wall of the positioning base.

3. Demountable showerhead with tearing mode according to claim 1, wherein the external surface of the connector is coplanar with the external surface of the bottom of the bowl shape plug, the internal surface of the connector is coupled to the external wall of the outlet surface.

4. Demountable showerhead with tearing mode according to claim 3, wherein the external edge of the connector is laterally disposed with a protruding portion, the protruding portion is fixed with a flexible spot;

the spot is inserted into a hole of the outlet surface.

5. Demountable showerhead with tearing mode according to claim 1, wherein the internal wall and the external wall of the bowl shape plug and the outlet waterways are smooth taperhole shaped.

6. Demountable showerhead with tearing mode according to claim 1, wherein the bowl shape plugs and the connector are one step forming, and are made of silicon.

7. Demountable showerhead with tearing mode according to claim 1, wherein the bowl shape plugs are symmetrically arranged about the central axis of the outlet surface of the shower.

8. Demountable showerhead with tearing mode according to claim 1, wherein the interference of the external wall of the bowl shape plug and the outlet waterway is larger than 0.4 mm.

9. Demountable showerhead with tearing mode according to claim 8, wherein the guiding length of the external wall of the bowl shape plug coupled to the outlet waterway along the outlet direction of the shower is larger than 2.2 mm.

* * * * *